US005192152A

United States Patent [19]

Silvestri et al.

[11] Patent Number: 5,192,152

[45] Date of Patent: Mar. 9, 1993

[54] SWITCH ACTUATOR

[75] Inventors: James T. Silvestri, Woodlands; Todd D. Podhaisky, Spring; Timothy E. Klein, Cypress; Mark W. Baker, Spring; David J. Czarnek, Houston, all of Tex.

[73] Assignee: Compaq Computer Corporation, Houston, Tex.

[21] Appl. No.: 708,344

[22] Filed: May 31, 1991

[51] Int. Cl.[5] ..... B41J 29/00

[52] U.S. Cl. ..... 400/679; 400/180; 400/473; 400/719

[58] Field of Search ..... 400/180, 181, 473, 474, 400/679, 719; 92/24, 27, 28

[56] References Cited

U.S. PATENT DOCUMENTS

| | | | |
|---|---|---|---|
| 3,768,622 | 10/1973 | Wood | 400/473 |
| 4,313,273 | 2/1982 | Matthews et al. | 42/71.02 |
| 4,441,833 | 4/1984 | Hasenbalg | 400/180 |
| 4,543,000 | 9/1985 | Hasenbalg | 400/473 |
| 4,937,964 | 7/1990 | Crandall | 42/69.03 |

FOREIGN PATENT DOCUMENTS

| | | | |
|---|---|---|---|
| 0119079 | 5/1987 | Japan | 400/180 |
| 1158381 | 5/1985 | U.S.S.R. | 400/473 |

OTHER PUBLICATIONS

"Hasco Design Overview Jan. 2, 1991" Hasco Technology, Inc.

*Primary Examiner*—Edgar S. Burr
*Assistant Examiner*—Ren Yan
*Attorney, Agent, or Firm*—Christopher D. Keirs

[57] ABSTRACT

An automatic switch actuator is disclosed which may be used to test press-to-actuate type switches—for example, the key actuated switches of a computer keyboard. In the illustrated embodiment of the invention, a system of electrically operated valves are used to apply four different fluid pressures to selected pistons of an array of pneumatic cylinders. Each cylinder is mechanically connected to a plunger which is oriented so as to contact a selected key in an array of keys (i.e., a keyboard). The four fluid pressures applied are: (1) sub-ambient ("vacuum") which is used to retract the plungers thereby permitting easy loading and unloading of units under test; (2) "atmospheric" which is used to rest the plungers directly on the keycaps thereby minimizing dynamic loading of keys during the test; (3) "low pressure" which is selected to lower the plungers onto the keycaps and subsequently to apply a predetermined force which should not cause switch actuation; and, (4) "high pressure" which is selected to provide the minimum acceptable force on the plunger required to cause key actuation. The key switches are monitored for actuation by a computer which computer may also be conveniently used to control the pneumatic cylinders.

4 Claims, 8 Drawing Sheets

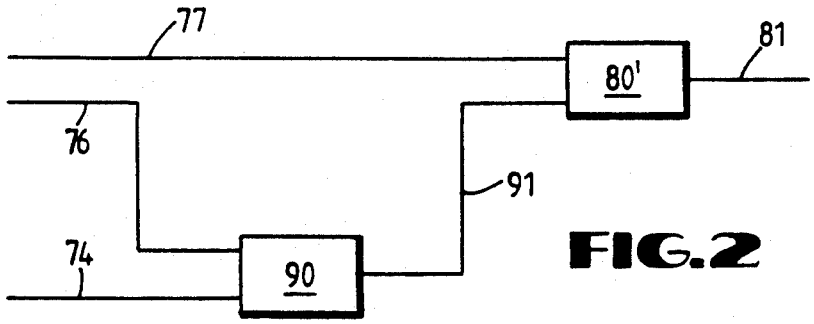
FIG.2
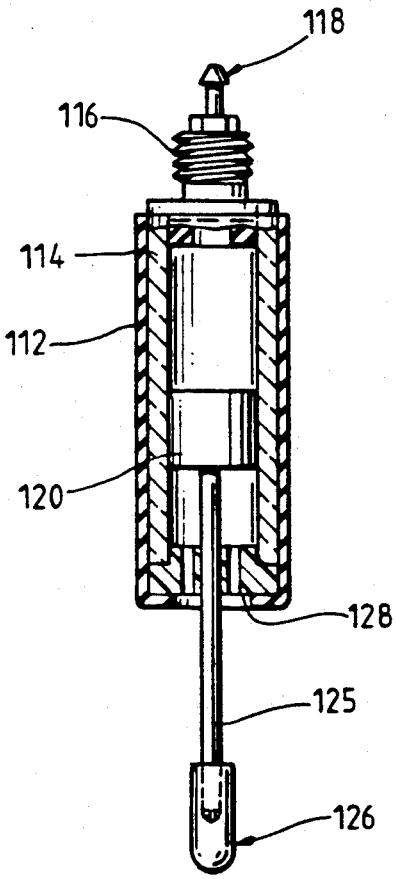
FIG.3
FIG.4A
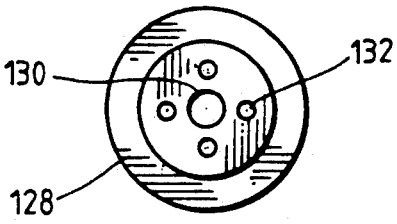
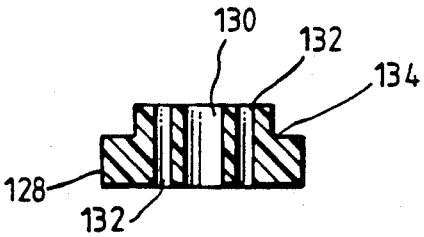
FIG.4B
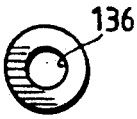
FIG.5B
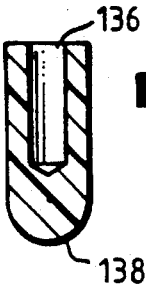
FIG.5A RELAYON
CONVCLK
ONE
U6A
74HCT74
U5B
U5A
U4A
U4B
U4C
U4F
U8A
U8B
U9B
74HCT04
74HCT02
74HCT00
X1
OUT
U3
4020
A[0..14]
GET1-
U298
74HCT244
U19
74HCT138
RN5A
100 Ohm
CNTRL01
CNTRL02
CNTRL03
CNTRL00
SW1
ND
U2
74HCT151
U12
74HCT244
U17
74HCT138
U1
74HCT151
U11
74HCT193
U13
74HCT193
VCC
AN1
2.2K
WRT8-
WRT7-

VCC
R27
2.2K
+5Ref
R3
4.99K
1%
U30
27C256
U31
DAC0802
U32A
LM324
R5
4.99K 1%
+12V
-12V
C31
0.1
µF
R4
0 Ohm
R5
0 Ohm
U320
LM324
R8
1K
2N3020
Q1
Q2
2N2222A
R9
10K
R10
1.0
Ohm
1%
R11
10K
1%
+17V
R7
47K
U328
LM324
A[0..14]
CONVCLK
GETI-
GETCURR-
C[0..7]
R25
47K
R25
4.7K
TP4
K1 OS4E-
M-DC5V
J2
TO COMPUTER
KEYBOARD
CONNECTOR
103308-1
DATA
GND
CLK
U10F
74HCT05
U10B
74HCT05
RELAYON
SLEEPM-
D7
1N914B
R28
4.7K
J3
103308-1
TO
KEYBOARD
D1
1N4001
D2
1N4001
F1
1AMP 3AG
F2
1 AMP
3AG
P7
350211-2
AMP
BR1
2W10M
U35
LM7805
C35
1000µF
50VOLT
U36
LM7812
C36
470µF
25 VOLT
C37
470µF
25VOLT
U37
LM7912
C32
0.1µF
C33
0.1µF
C38
0.1µF
C39
0.1µF
V+
V-
TP1
TP2
C1 C2 C3 C4 C5 C6 C8 C9 C10 C11 C12 C13 C14 C15 C16
C17 C18 C19 C20 C21 C22 C23 C25 C26 C27 C28 C29 C30 C34

SWITCH ACTUATOR

BACKGROUND OF THE INVENTION

1. Field of the Invention

This invention relates to electrical switches of the press-to-actuate type. More particularly, it relates to the testing of electrical switches in a keyboard.

2. Description of the Related Art

Alpha-numeric keyboards of the type used for personal computers and the like can be tested using commercially-available pneumatic devices such as that described in U.S. Pat. No. 4,441,833 to Hasenbalg. In such devices, a pneumatic cylinders are connected to plungers which contact a particular keycap on the keyboard. Signals from the keyboard are monitored to determine whether a selected key has in fact been actuated when depressed by the corresponding plunger.

In Hasenbalg's apparatus, two pneumatic signals are required to actuate a particular plunger: a drive fluid; and, a latch release fluid. In this manner, a logical AND operation can be performed by each actuator and solenoid controlled valves can be employed in a matrix of "drive" columns and "latch release" rows, thereby minimizing the number of valves required in the system.

The piston in this type of apparatus acts against a spring which provides a return force to retract the plunger following actuation.

A disadvantage inherent in this type of tester is that the keys of the keyboard unit under test (UUT) are dynamically loaded. That is, the plunger contacts the keycap at a time when the piston (and its associated plunger) are in motion. Since any mass in motion has momentum, it is difficult to know or select the amount of force actually being experienced by the key switch as it is depressed by the plunger. A constant, easily-measured static force cannot be applied.

For example, it is often desired to test keyboards for sensitivity by applying a force to each keycap which should not cause switch actuation—e.g., the force applied by the fingers of a typist resting on the "home keys". This is a difficult test to accomplish using the type of apparatus described by Hasenbalg since if one selects a pneumatic pressure corresponding to the static force desired, that force will be exceeded when the extending plunger contacts the keycap owing to the momentum of the piston and plunger.

The present invention solves this problem and enables one to readily apply two different known forces to the keys of the unit under test. Most typically, these two forces will be that corresponding to a specified force which should not cause switch actuation and a different, higher force which is the minimum acceptable force for switch closure.

SUMMARY OF THE INVENTION

In the present invention, a system of electrically operated valves are used to apply four different fluid pressures to selected pistons of an array of pneumatic cylinders. Each cylinder is mechanically connected to a plunger which is oriented so as to contact a selected key in an array of keys (i.e., a keyboard). The key switches are monitored for actuation by a computer which computer may also be conveniently used to control the pneumatic cylinders.

In one preferred embodiment, the four fluid pressures applied are: (1) sub-ambient ("vacuum") which is used to retract the plungers thereby permitting easy loading and unloading of units under test; (2) "atmospheric" which is used to rest the plungers directly on the keycaps thereby minimizing dynamic loading of keys during the test; (3) "low pressure" which is selected to lower the plungers onto the keycaps and subsequently to apply a force which should not cause switch actuation; and, (4) "high pressure" which is selected to provide the minimum acceptable force on the plunger required to cause key actuation.

Preferably, the pneumatic cylinders employed in the apparatus of the present invention have low-mass, low-friction pistons. Most preferably, the cylinders have glass walls and graphite pistons.

BRIEF DESCRIPTION OF THE DRAWINGS

FIG. 2 is a block diagram of an alternative embodiment of the valving for a particular actuator.

FIG. 3 is a cross sectional view of one preferred pneumatic actuator.

FIG. 4 illustrates a preferred actuator rod guide.

FIG. 5 shows a preferred end tip for an actuator rod.

DETAILED DESCRIPTION

One particularly preferred embodiment of the present invention is described in detail immediately below. This particular embodiment is directed towards a desktop personal computer keyboard tester. Such keyboards most commonly have between about 80 to about 102 individual key-actuated switches arranged approximately as shown in element 40 of FIG. 1. Single keycaps of such keyboards are typically about 12 mm×15 mm on their upper surface and have a center-to-center spacing of about 2 cm. However, such keyboards also typically include a number of "multiwide keys" such as the space bar, shift keys, backspace key and return key which have larger upper surfaces than the alphanumeric, numeric keypad and function keys (which are all typically included on such keyboards). It has been found, however, that the present invention may readily be used to test switches other than key-actuated switches. In fact, any press-to-actuate type switch may be tested by an apparatus which embodies the present invention. It has been found that even the membrane switches commonly used in computer keyboards may be directly tested (i.e., separate and apart from the keycaps and plungers of a finished keyboard) on the tester described below.

Figure 1:
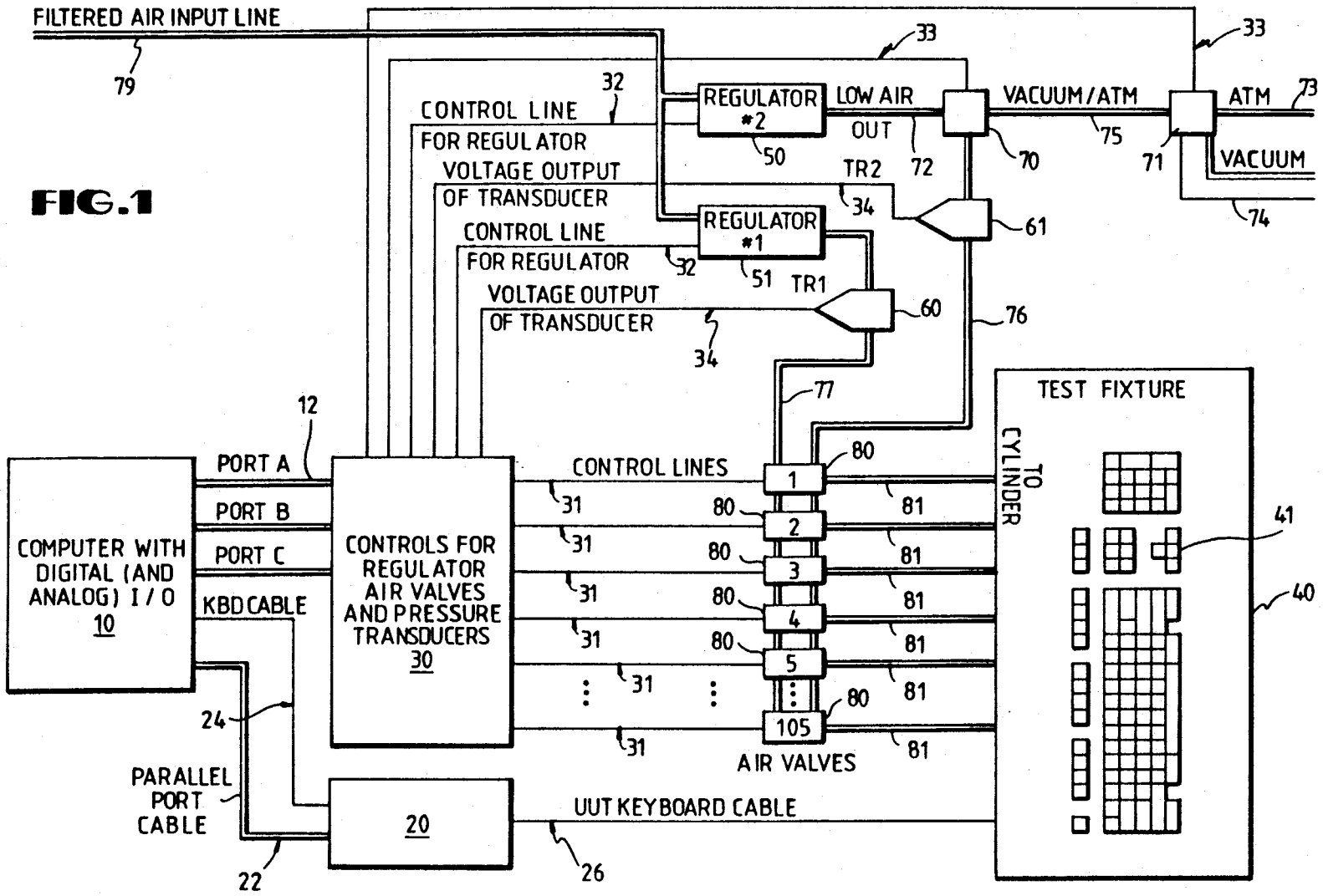
FIG. 1 is block diagram of the present invention.

In the block diagram of FIG. 1, keyboard unit under test (UUT) 40 has a plurality of keys 41 which when depressed should produce unique electrical signals on UUT keyboard cable 26 if the UUT is provided with proper power and control signals from host computer 10. Such power and control signals are also carried in keyboard cable 26.

Figure 7A:
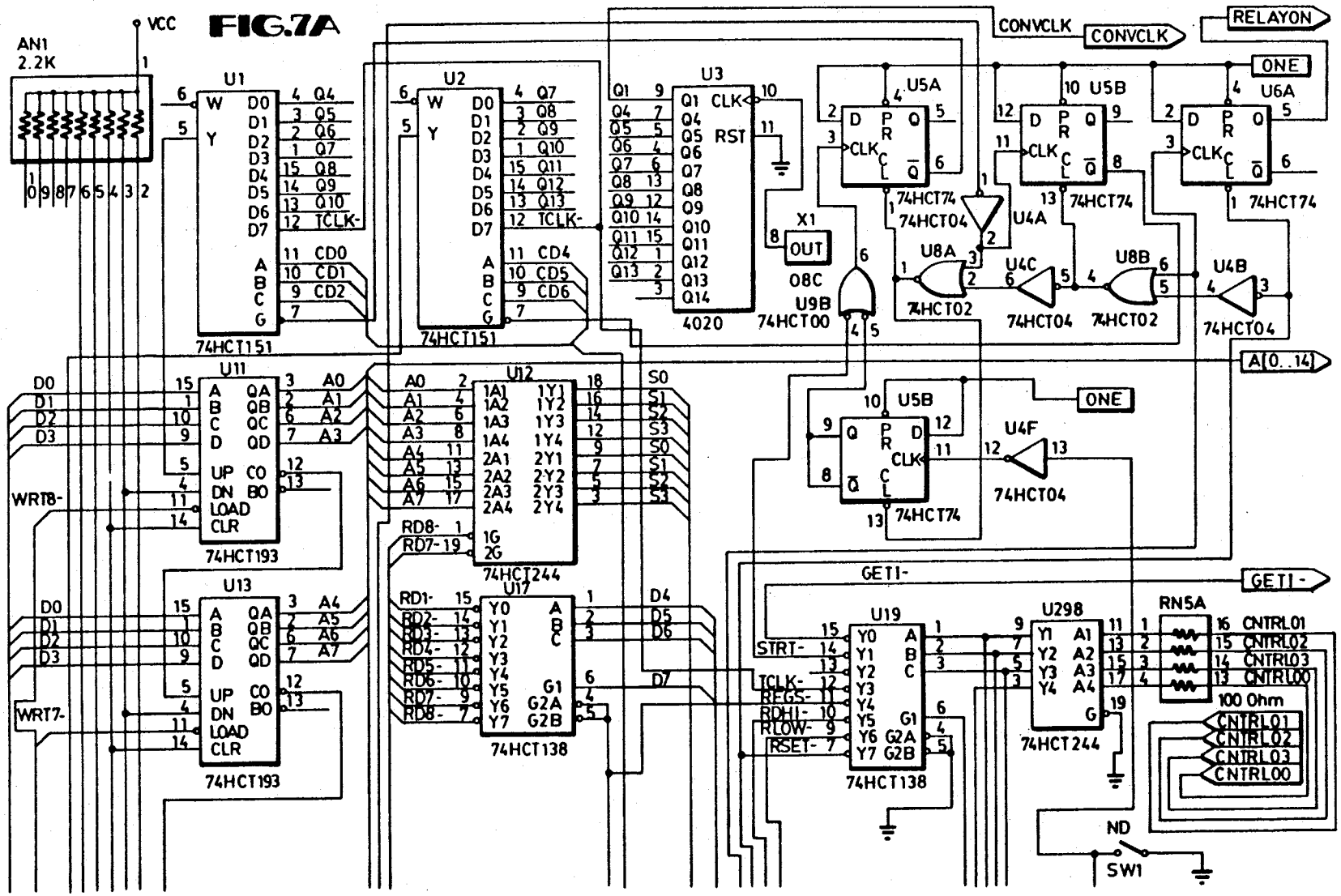
FIG. 7 is an electrical schematic diagram of the digital portions of one preferred keyboard connection interface.
Figure 7B:
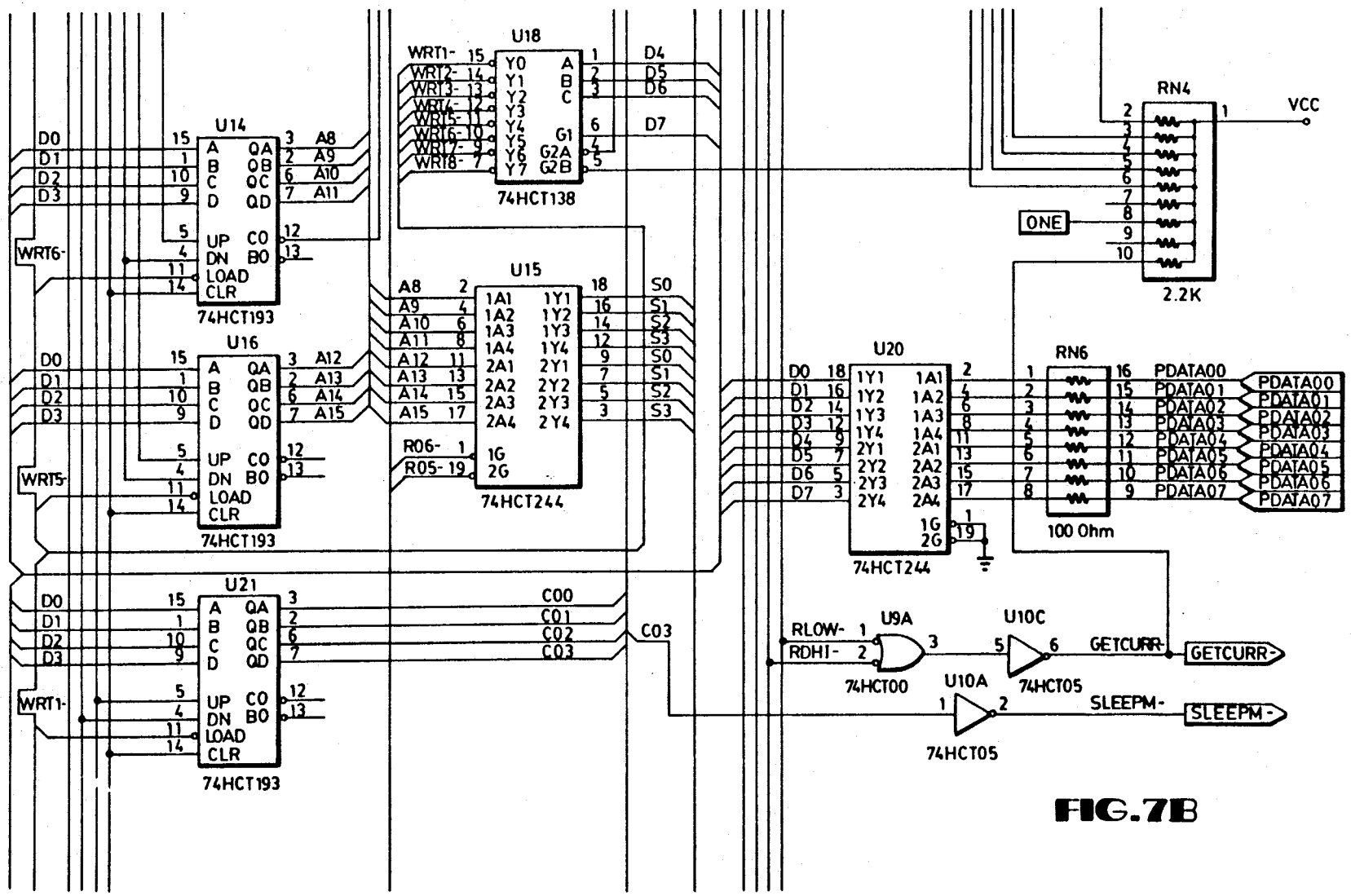
Figure 7E:
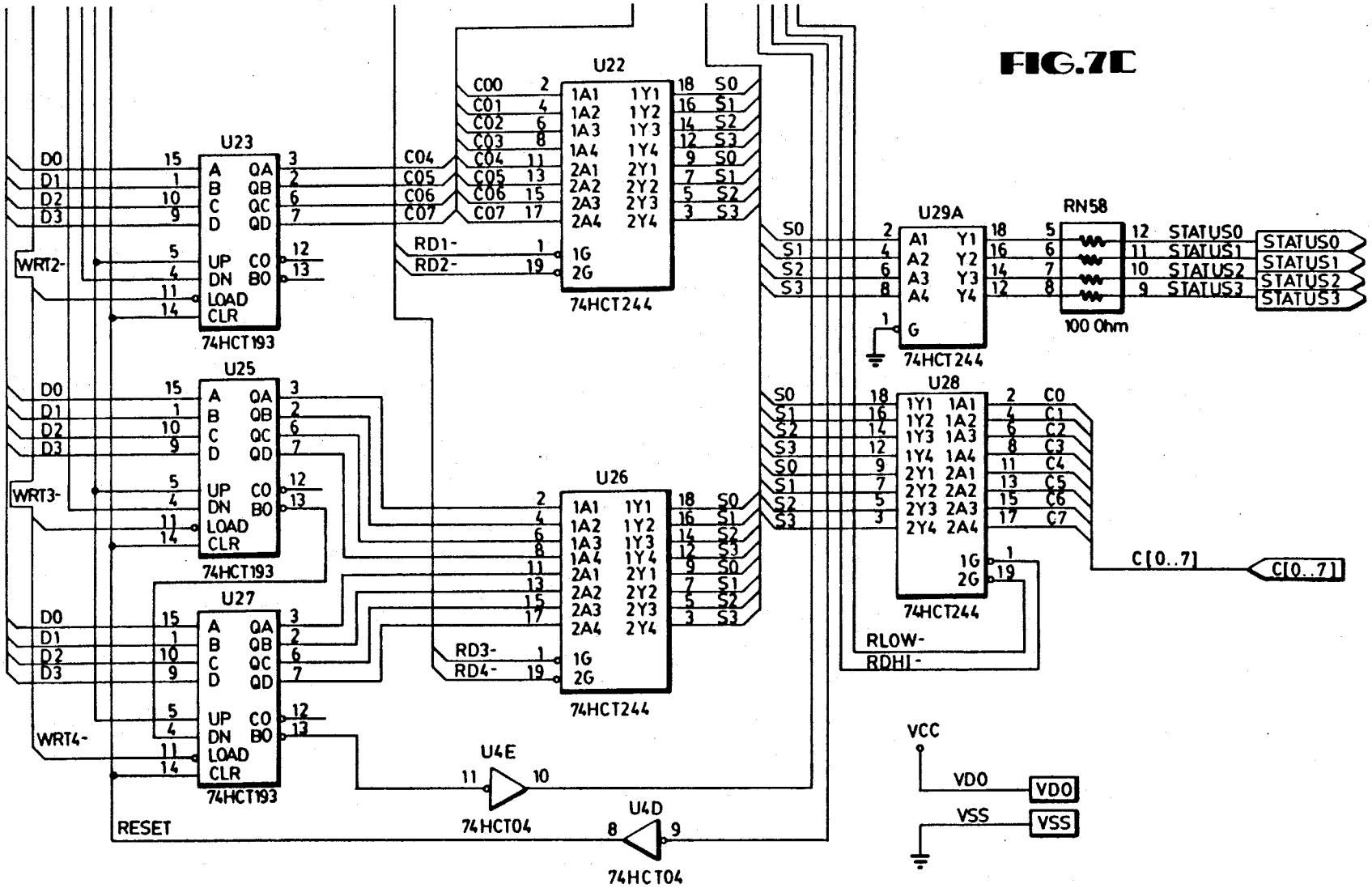
Figure 8A:
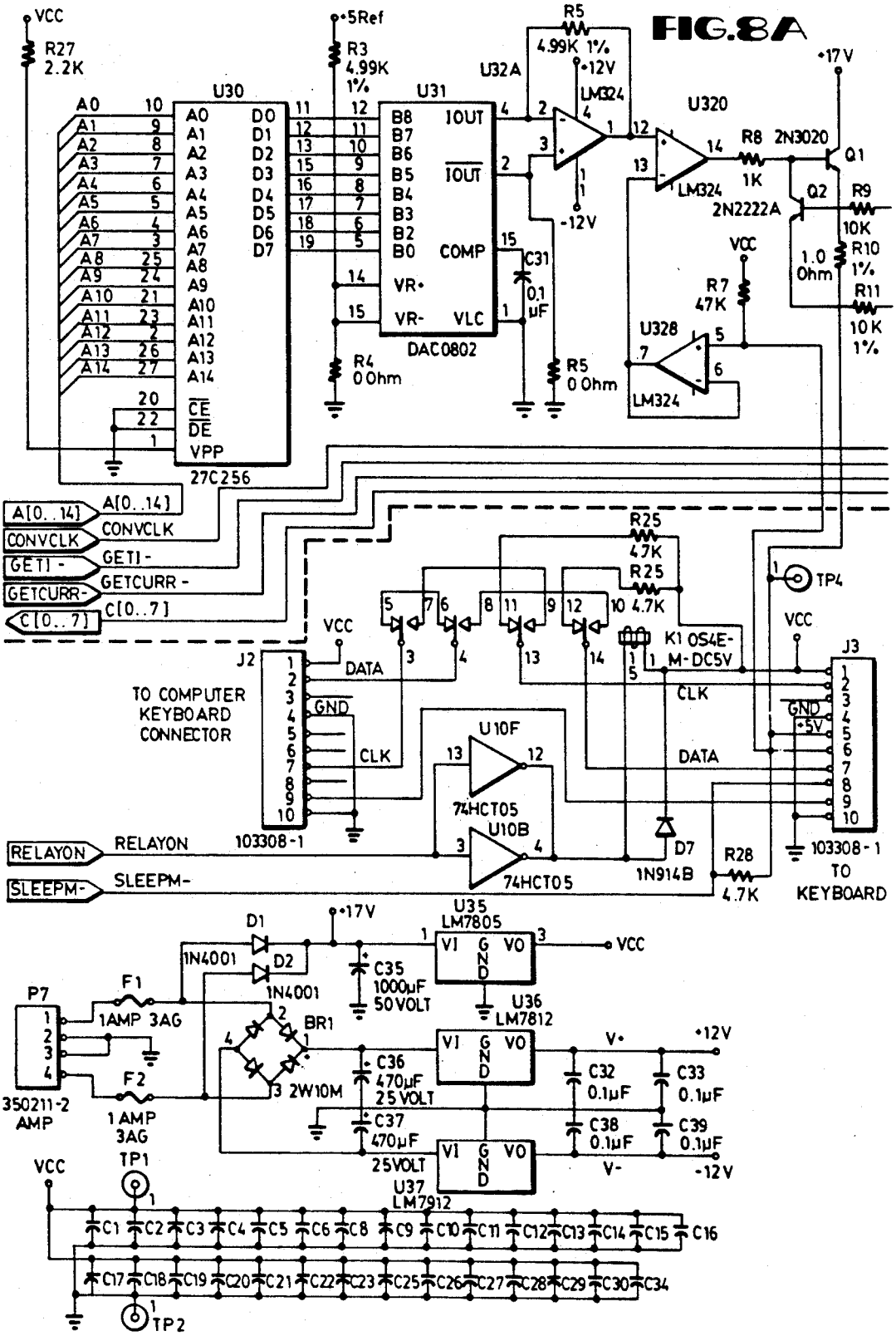
FIG. 8 is an electrical schematic diagram of the analog portions of one preferred keyboard connection interface.
Figure 8B:
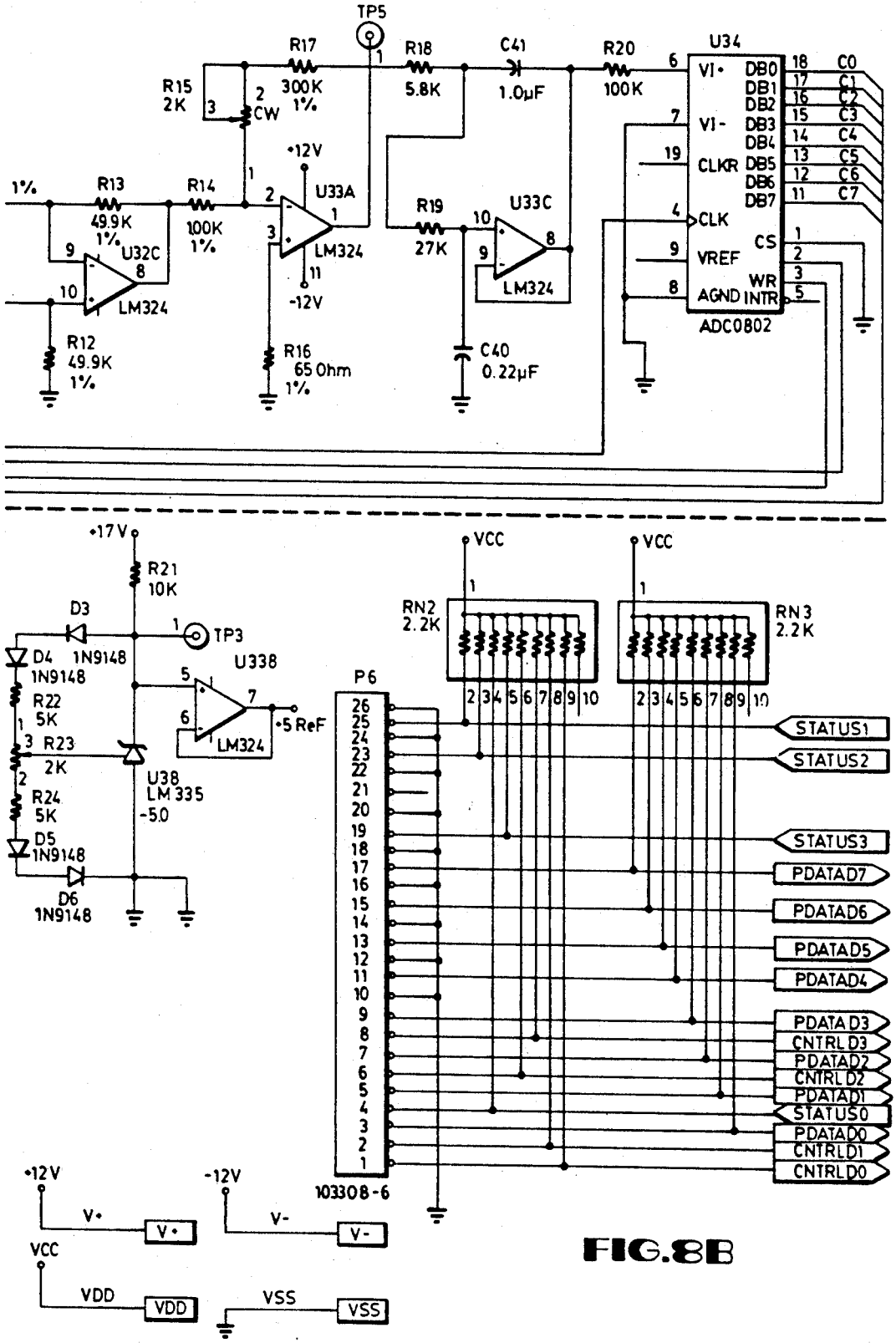

As explained in more detail below, it is undesirable to connect or disconnect a keyboard from its host computer when the computer is operating. To avoid having to remove power from host computer 10 prior to connecting or disconnecting each keyboard UUT 40, hot-connect interface box 20 is provided which communicates with host computer 10 via control cable 22 and keyboard cable 24 and with UUT keyboard 40 via UUT cable 26. The design and operation of hot-connect interface 20 is described below and the digital portions of the design are shown in schematic form in FIG. 7 and the analog portions of the interface are shown in schematic form in FIG. 8.

Host computer 10 is equipped with an interface having digital and analog input/output (I/O) ports 12 which are used to electrically communicate with air control circuitry 30 which comprises the various drivers needed for the electrically actuated solenoid valves, pressure transducers and pressure regulators employed by the apparatus. In a conventional way, the drivers convert the TTL level signals provided from the computer 10 via ports 12 to the appropriate voltages and currents required to control the electromechanical elements.

It will be appreciated by those skilled in the art that a variety of working fluids may be employed in an apparatus of the type disclosed herein. In the embodiment described it was found that air acting on pneumatic cylinders was convenient. However, other gasses (e.g., nitrogen, argon, carbon dioxide, etc.) could also be employed. Hydraulic fluids acting on hydraulic cylinders could also be used but such use would require different valve and actuator means. It is contemplated that the use of hydraulic fluids would be less desirable because the actuators would be more massive and slower in response owing to the greater viscosity of liquids as compared to gasses. However, the invention could be practiced with liquids as the working fluid and there may be applications where the use of a liquid working fluid would be preferred. Air previously filtered through a 40-micron filter (not shown) regulated to a pressure of about 25 psig enters the apparatus via air input line 79 and is routed to electrically-controlled pressure regulators 50 and 51. A suitable regulator for this application is the Bellofram type 1001 E/P transducer Model No. 241-966-360-000 (Bellofram Corporation, Newell, W. Va. 26050). Signals from air control circuitry 30 are used to set the regulators' output pressure via regulator control lines 32.

Typically, regulator 50 is set at a lower pressure than regulator 51. Hence, the output of regulator 50 is connected to "lower pressure" air line 72 and the output of regulator 51 is connected to "higher pressure" air line 77. The air pressure in air line 77 is monitored by pressure transducer 60 which sends an electrical signal corresponding to the pressure via pressure transducer output signal line 34 to air control cicuitry 30. A suitable pressure transducer for this application has been found to be the Omega Industrial Pressure Transducer Model PX180-015GV (Omega Engineering, Inc., Stamford, Conn. 06906)

The output of pressure regulator 50 is passed via lower pressure air line 72 to air source valve 70, an electrically actuated valve which can be selected to connect air line 76 to either lower pressure air line 72 or air line 75 in response to a signal on air source valve control line 33 from air control circuitry 30 in response to commands issued by host computer 10. A particularly suitable valve for this purpose has been found to be the Festo Model 7958 MFH-3-1/8-S which operates with a 24-vdc control signal (Festo Corp. Hauppauge, N.Y. 11788). Air line 75 which comprises one of the inputs to air source valve 70 is the output line of a similar air source valve 71 the inputs of which are a vent to atmosphere 73 and "vacuum" line 74. In this context, "vacuum" is not a high vacuum, but rather a reduced pressure (i.e. subambient). A "vacuum" of about 9.5 inHg produced by a simple aspirator has been found convenient in this application.

Thus, it will be appreciated that by selecting the positions of air source valves 70 and 71, air line 76 can be provided with pressurized air at a pressure selected by regulator 50, atmospheric pressure, or "vacuum". The pressure in air line 76 is detected by pressure transducer 61 which may be of the same kind as pressure transducer 60. The output signal from pressure transducer 61 is sent via pressure transducer output signal line 34 to air control circuitry 30 and subsequently to host computer 10.

Pressure transducers 60 and 61 provide feedback means to ensure that the desired output pressures of regulators 50 and 51 are in fact achieved. If a discrepancy is noted by the host computer 10, the signals to the regulators can be adjusted as appropriate to achieve the desired air pressures. In this way, the apparatus does not rely on the calibration data of the electrically controlled pressure regulators.

Higher pressure air line 77 and air line 76 provide the inputs to a series of pneumatic valves 80, each of which is dedicated to the control of a particular one of the pneumatic actuators of the apparatus. The valve, in response to electrical signals from air control circuitry 30 sent via air valve control lines 31, connects an actuator to either higher pressure air line 77 or air line 76 which as noted above can be supplied with the output of lower pressure regulator 50, "vacuum" or be a vent to atmospheric pressure. Thus, by selecting the positions of valves 80, 70 and 71, any actuator may be supplied with pressurized air from the output of regulator 50, pressurized air from the output of regulator 51, "vacuum", or atmospheric pressure. For reasons set forth below, the "normal" (i.e. unpowered) positions of valves 80, 70 and 71 are preferably connected so that when power is removed from the apparatus, vacuum is applied to each of the pneumatic actuators causing them to retract.

A particularly convenient valve 80 to use for the actuators has been found to be the Pneutronics Model 11-18-5-BV-24-S printed circuit board mount pneumatic valve which operates with a 24-volt, 20 mA signal (LDI Pneutronics, Hollis, N.H. 03049).

It has been found convenient to provide certain actuators with means to retract while leaving the other actuators in the array in an extended position. For example, if it is desired to test two or more varieties of keyboards without installing a different actuator support plate (with a differently arranged set of actuators), it may suffice to provide an actuator array with a greater number of actuators than is required for every species of keyboard and retract those actuators which are not needed for that particular species. It has been found that an industry standard 101-key PC keyboard may be tested on the same apparatus used to test international keyboards having 102 keys. FIG. 2 illustrates in block diagram form one way in which a particular actuator may be provided with the separate retraction feature described above. One of the supply lines to actuator control valve 80" is provided with air source valve 90 which may be the same type of remotely operated valves as valve 80 or valves 70 and 71. The supply lines to valve 90 are air line 76 (the lower pressure line) and the "vacuum" line 74. Thus, by selecting the position of valve 90, either the pressure of line 76 or "vacuum" may be provided to line 91 which in turn may be supplied to the actuator via line 81' by appropriate selection of the position of air actuator valve 80'. It should be appreciated that valve 90 may be inserted into line 77 (the higher pressure line), although as noted above it is preferable to provide vacuum through the normal position of all valves so that the actuators will be retracted when electrical power is removed from the system.

Actuator air lines 81 are connected to individual pneumatic actuators 100. FIG. 3 is a cross sectional view of an actuator used in the illustrated embodiment. The actuator comprises piston 120 which acts in cylinder 110 to move piston rod 125. Piston rod 125 is attached to piston 120 with a ball and socket joint. Rod guide 128 positions piston rod 125 and ensures linear actuation. The end of rod 125 which extends out of cylinder 110 is provided with end tip 126 which is more fully illustrated in FIG. 5.

The top of cylinder 110 is provided with cushioning washer 114 which cushions the up stroke of piston 120. The actuator is also provided with threaded connector 116 for mounting purposes and air line connector 118 for connection to the actuation fluid supplies. In the illustrated embodiment, air lines 81 are connected to the connectors 118 of individual pneumatic actuators 100. Rod guide 128 is secured to cylinder 110 with EPDM rubber boot 112.

A preferred actuator for embodiments used for testing computer keyboards is the Airpot Series 56 pneumatic actuator (Airpot Corporation, Norwalk, Conn. modified with the addition of rod guide 128 and end tip 126. These actuators comprise a low friction graphite piston in a tempered glass cylinder.

FIG. 4 illustrates one preferred rod guide for use in the above-described actuator. FIG. 4*a* is a top plan view of the rod guide; and, FIG. 4*b* is a cross sectional view. In the illustrated embodiment, the rod guide is machined from delrin stock. Rod guide 128 comprises central passage 130 through which piston rod 125 moves. Air vents 132 are provided to relieve the pressure generated by the action of piston 120 in cylinder 110 when the rod 125 extends and to admit air when piston 120 is moved up to retract rod 125. Shoulder 134 is provided to mount rod guide in cylinder 110 as shown.

FIG. 5 is a cross sectional view of end tip 126 which may be fabricated from delrin. The illustrated tip is one preferred for testing key-type switches. It comprises channel 136 for press connection onto the end of piston rod 125 and hemispherical tip 138 for contacting the keycap. Other tip shapes may be preferred for other applications. For example, a flatter tip 138 may be preferred for testing switch membranes directly (i.e., without keycaps, plungers and rubber domes).

It will be appreciated by those skilled in the art that the present invention's feature of being able to rest the plunger on the keycap prior to test has the additional advantage of compensating for angled or tilted keyboards. Often, for ergonomic reasons computer keyboards are fabricated with an angle or tilt—i.e., an upper row of keys will be at a higher elevation from a horizontal, planar surface supporting the keyboard (e.g., a desktop) relative to a lower row of keys. Plungers for lower row keys simply extend further to rest on the keycaps than those for upper row keys. Piston stroke may be selected to accommodate the range of elevations expected in units under test. This feature allows the pneumatic cylinders to be mounted in a simple flat plate or the like without the need for elaborate actuator alignment means such as that used in the devices of the prior art (see e.g., FIG. 3 of U.S. Pat. No. 4,441,833). With the plungers resting on the keycaps prior to actuation, one can ensure that stroke actuation for the key depression test corresponds to key travel and that any dynamic effects are both minimized and equalized for rows having different elevations.

Figure 6:
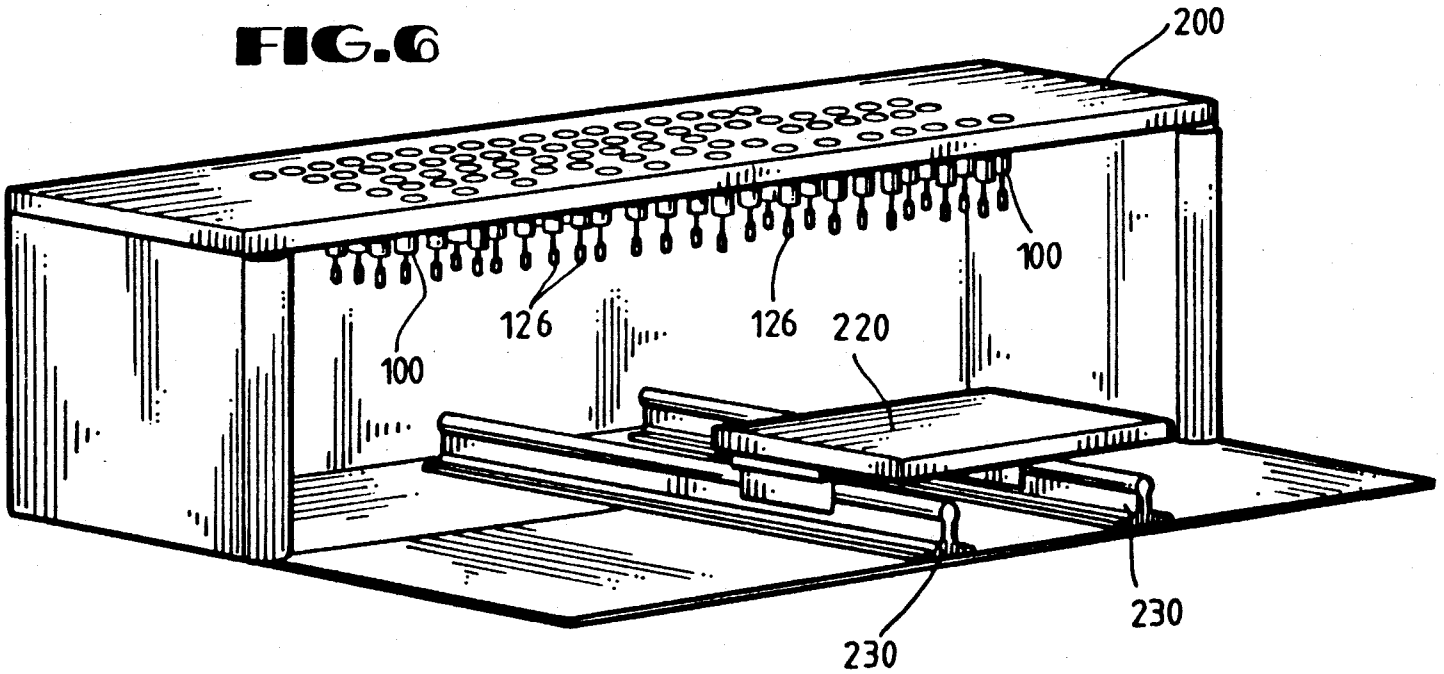
FIG. 6 shows a portion of a keyboard test apparatus which embodies the present invention.

FIG. 6 illustrates a portion of a keyboard tester which embodies the present invention. Pneumatic actuators 100 are mounted to actuator support plate 200 by means of threaded connector 116. The keyboard unit under test is held by suitable support means on keyboard carriage 220 which is slidably mounted on rails 230. In operation, the keyboard to be tested is attached to keyboard carriage 220 and then slid on rails 230 to position the keyboard such that the corresponding end tips 126 of piston rods 125 will contact the appropriate keycaps upon actuation of the pneumatic actuators 100. The sliding of carriage 220 on rails 230 may also be accomplished by a pneumatic actuator under control of the host computer.

The keyboard "hot-connect" interface 20 allows for the removal and replacement of a keyboard from a powered up computer system in a controlled manner. Normally, to connect a keyboard to a computer system it is necessary to cold-boot the computer so that the correct keyboard handshaking does not affect the computer. Typically, when a keyboard is powered up, it performs a quick reset and then attempts to transmit to the host computer several items of data. If the host computer is not expecting this data packet, it often cannot handle this unexpected data. In such event the host computer will often lock up. Also, there exists the possibility that when the keyboard plug is inserted into the computer, the increase loading of the computer's power supply may cause unexpected events to occur.

The purpose of the keyboard "hot connect" interface is to overcome these problems by providing a controlled connection between the host computer and the newly connected keyboard (e.g., unit under test). This allows for the change out of a keyboard from a host computer without the necessity of a cold boot of the computer system. In addition to its use in the subject invention, this device may be advantageously used in any situation where the connection and disconnection of a powered up computer may be necessary or desirable.

Additionally, the keyboard hot-connect interface simulates the Vcc power up waveform of the host computer system. Without this feature, a keyboard would experience a near immediate Vcc change of from 0 to +5 vdc. Such voltage change differs greatly from the voltage waveform experienced by a keyboard connected to a computer prior to power application. By providing a Vcc waveform which approximates the normal environment of a keyboard several potential problems with the keyboard reset circuit can be thoroughly tested. The circuitry of the hot connect interface described herein allows for a maximum of eight different Vcc waveforms to be recorded into a standard EPROM. Most preferably, these waveforms will be recorded from actual operating computer systems in order to best represent connection to the computer being simulated. The time at which the Vcc signal will ramp to full voltage can also be user-defined.

Once the Vcc signal has reached its maximum, a digital timer interposes a preselected interval prior to closing a relay which enables the keyboard clock and data signals to pass to the host computer. The digital timer employs an eight-bit counter which is loaded with a value corresponding to the time interval desired. Since the clock signal that is used to decrement this counter has a user-defined frequency, a wide range of time intervals is available for selection.

All timing and control functions of the keyboard hot-connect interface operate from digital control circuitry. This enhances the repeatability of test functions both between interfaces and over time and also lessens dependence on any particular sample of interface. In the design disclosed herein, there are only two adjustable components in the interface—the +5 volt reference (used as a reference for the digital-to-analog converter which generates the Vcc waveform for the keyboard unit under test); and, the amplifier used to sample the keyboard current. The amplifier adjustment allows for compensation of component tolerances of the sampled current before being digitized.

To enhance maintenance, the interface of the present invention also includes additional circuitry to aid the repair and maintenance of the interface. A computer program executing on the host computer can run a diagnostic check of the digital circuitry of the interface. Such test can involve the loading of each of the many registers and counters while ensuring that each has been loaded with the correct value. Additionally, an external signal source can generate the clock signals used to change the state of the counters.

THEORY OF OPERATION

Power Supply: The power supply employed by the hot-connect interface disclosed herein utilizes a simple linear series regulator. AC line voltage is stepped down via a 24VCT 400MA transformer. The 24-volt poser is then rectified by diodes D1 and D2 and filtered by C35 to provide the main power used by the digital sections of the interface. This 17-volt power is regulated to +5 volts by U35. Regulator U35 is a LM7805 series regulator capable of supplying +5.0 volts at 1 amp. To provide the +12 and −12 volts used by the analog circuitry of the interface, the raw 24-volt AC power is rectified by diode bridge BR1 and filtered by C36 and C37 and is then regulated by U36 and U37 to provide the +12 and −12 volt supplies. U36 and U37 are respectively +12 and −12 volt series pass regulators capable of supplying 100 mA each.

The circuitry consisting of U38, D3–D6, R22–R24 and U33-B comprises a precision +5.00-volt voltage reference. It is this reference source that is used to control the maximum output voltage of the DAC converter that generates the keyboard ramp voltage. Trim potentiometer R23 is used to "fine tune" the voltage reference to +5.00 volts and has the added advantage of decreasing the temperature drift of this reference.

HOST COMPUTER CONTROL LOGIC

All communications between the interface and the host computer is performed via the computer's parallel port. Each signal from the computer is pulled high through resistor packs RN2 and RN3 in the interface. This ensures that all signals will be in a known state should the cable connecting the interface and the host computer be disconnected. Each signal is also terminated by a series resistor pack RN5 and RN6 to dampen standing waves on the connector cable caused by the high switch times and the length of the cable.

The host computer printer port consists of one 4-bit control port used to output data to the interface, one 4-bit status port to read data from the interface, and an 8-bit data port also used to output data to the interface. The control port is used to select one of the various register sets and strobes the data into the selected register. The control bus is buffered by U29B and is decoded by U19. The 8-bit data bus is buffered by U20 while the status bus is buffered by U29A.

ADDRESS COUNTER

As a waveform is being generated, the address counter simply counts through 4096 consecutive locations of the EPROM with each address location being the instantaneous voltage for that time interval. The address counter consists of four 74HCT193 up/down counters at locations U11, U13, U14 and U15. Actually, only three of these devices are used in the counter chain while the fourth U15 is used to select one of eight possible waveforms that are stored within the EPROM. In order to make the Vcc ramp time as flexible as possible, one of seven possible clock signals can be selected by U1. With these seven clock signals, the complete 4096 word range of the waveform generator can be "played" in as little as 0.131 second to as long as 8.388 seconds. Since each clock is half as fast as the clock previous to it, each timing increment is twice as long. The eighth clock signal is reserved for use by the diagnostic software so that the clock can be fully under software control. Since there is no real need for the ramp to use all 4096 addresses within the EPROM, the waveform data can be altered to have the Vcc signal up to the full 5.0 volts earlier then what the timing circuits would seem to allow. For example, for demonstration purposes, it was desired to have the waveform ramp from 0 to 5.0 volts in exactly 100 mS. This was accomplished by setting the timing clocks to "play" the waveform with the fastest clock which would be complete in 131 mS and using only 3125 of the 4096 possible storage locations to store the waveform data. All locations past the 3125th location were filled with the data that would maintain the waveform at the full 5.0 volt setting.

DELAY COUNTER

After the Vcc waveform has been generated, there needs to be a way to delay the closure of the relay that passes the "clock" and "data" signals from the keyboard unit under test to the host computer. This task is accomplished by the use of a second counter chain consisting of U21 and U23. Again to make the timing delay as flexible as possible, one can select one of seven clock signals to operate this counter chain. In each case, one can precisely adjust the timing delay by altering the data values that are stored in the counter before the process begins. With the full count stored in this timer, timing delays of from 0.065 to 4.194 seconds are possible.

DAC CIRCUITRY

A particularly important portion of the waveform circuitry is the digital-to-analog converter ("DAC"). This comprises U31, U32-A, U32-B, U32-D and R3–R8. As each data word is read from the EPROM, this data is converted to analog currents by U31 and then to analog voltages by U32-A. This analog voltage is used to control Q1 which is wired as a common emitter amplifier. In this configuration, there is little voltage gain but a large current gain is possible. This current is used to power the keyboard under test. To correct for voltage losses interanl to the interface, a sense line connected directly to the keyboard connector feeds back into a voltage follower U32-B for impedance matching then to U32-D with is the error amplifier. It is this error amplifier that will alter the drive to Q1 to correct for any voltage losses internal to the interface box.

CURRENT MEASUREMENT

An additional feature of the hot-connect interface is its ability to measure the current being drawn by the keyboard unit under test. This is done by sampling the current through R10, converting this voltage drop to an analog voltage and converting the analog voltage to a digital word that can be read by the host computer. Thi circuitry is comprised of U32-C, U33-A, U33-C U34, R9-R20, C40 and C41. As noted above, R10 is the sense element which will drop 1 volt for each amp of current drawn. Since most keyboards can be expected to operate in the 0 to 0.25 ampere range, this resistor will drop 0 to 0.25 volt. U32-C and U33-A comprise the amplifier with an overall voltage gain of 20. This will increase the maximum 0.25 voltage drop across R10 to a 5.0-volt signal that is digitized by U34. U33-C, R19, C40 and C41 comprise a low-pass filter which removes any noise less than approximately 20 Hz.

KEYBOARD RELAY

Once the Vcc waveform has reached full voltage and the delay interval has elapsed, then the last step is to pass the keyboard clock and data signals to the host computer. This may be simply accomplished by closing a relay which switches these two signals. Before this relay changes states, it has been used to simulate a keyboard loop-back plug to the host computer and the keyboard unit under test has had its clock and data lines pulled high with 4.7 Kohm resistors. After the relay changes states, the pull-up resistors and the loop-back plug are switched out of the circuit.

DEBUG CIRCUITRY

In order the make the hot-connect interface easy to troubleshoot and to provide a means for ensuring that all circuitry is working properly, some additional circuitry is included in the design disclosed herein. Buffers U12, U15, U22 and U26 allow a diagnostic or host computer to write and read the contents of each of the devices in each of the counter chains. Diagnostic software can readily be written by those skilled in this art which will write and then read back data values into each of the counters to ensure that each is working properly. Also, there is a test clock, "TCLK" which can be used to count each timer chain under software control so that the counting functions can be tested.

OPERATION SEQUENCE

One preferred method of using the illustrated apparatus to test a personal computer keyboard comprises the following steps which are accomplished under programmed control by host computer 10 via I/O ports 12.

1. Air source valves 70 and 71 are positioned so as to furnish "vacuum" to air line 76 and all actuator control valves 80 are positioned to connect to line 76 thereby supplying vacuum to each pneumatic actuator 100 causing all piston rods 125 to retract;

2. Keyboard unit under test 40 is positioned under the array of pneumatic actuators;

3. Regulator 50 is set to a predetermined pressure which provides approximately 50% of the force used to test key switches for undesired actuation—i.e. the force exerted by resting fingers on the keycaps.

4. Air source valve 70 is positioned to connect lower pressure air line 72 from regulator 50 to air line 76 and the pressure within line 76 is monitored by pressure transducer 61 while any needed adjustment to the set point of regulator 50 is made to achieve the desired low pressure in line 76.

5. Each actuator control valve 80 is positioned to connect each actuator control line 81 to line 76 (if the position of any valve 80 has been changed from that selected in step 1, above) to cause each piston rod 125 to extend to contact the associated keycap.

6. The set point of regulator 50 is ramped at a rate of about 4.2 psi/sec to the pressure previously determined to provide the force desired to test the key switches for oversensitivity. This pressure is monitored by pressure transducer 61 and fed back to host computer 10 via signal line 34 and air control circuity 30 for any needed adjustment of the signal being sent on control line 32 to set regulator 50.

7. The signals on UUT cable 26 are monitored by host computer 10 for any switch closures while all pneumatic actuators maintain the previously selected force on the keycaps.

8. Air source valve 71 is positioned to connect air line 75 to atmospheric pressure line 73. Thus, provided no change has occured in the positions of air source valve 70 and actuator control valves 80, each pneumatic actuator 100 has atmospheric pressure on both sides of piston 120 and hence only the weight of the piston 120, piston rod 125 and end tip 126 are applied to each key switch and end tip 126 is resting directly on the keycap (or switch).

9. In a previously selected sequence stored in the program of host computer 10, each actuator control valve 80 is switched to connect the associated line 81 to air line 77 the pressure of which is set by regulators 51 (and monitored by pressure transducer 60) to provide the minimum force on the actuators which should cause switch closure. The output signals of the UUT keyboard 40 are monitored on line 26 to determine whether the appropriate signal is received.

10. Each control valve 80 and air source valves 70 and 71 are positioned to apply vacuum to lines 75, 76 and 81 thereby causing all pneumatic actuators to retract allowing each removal of the keyboard unit under test.

The foregoing description has been directed to particular embodiments of the invention in accordance with the requirements of the United States patent statutes for the purposes of illustration and explanation. It will be apparent to those skilled in this art, however, that many modifictions and changes in the apparatus and methods set forth will be possible without departing from the scope and spirit of the invention. It is intended that the following claims be interpreted to embrace all such modifications and changes.

What is claimed is:

1. An apparatus for testing press-to-actuate switches comprising:

a plurality of fluid-actuated actuators having an element which extends and retracts in response to fluid pressure with each actuator positioned to align its extending/retracting element with a corresponding switch in an array of switches;

means for supplying either a lower fluid pressure or a higher fluid pressure to any actuator;

means for selecting either a first fluid pressure or a second fluid pressure as the lower fluid pressure;

means for selecting either atmospheric or subatmospheric pressure as the second fluid pressure; and, control means for selecting the lower fluid pressure, higher fluid pressure, first fluid pressure, second fluid pressure, atmospheric pressure, and subatmospheric pressure.

2. A method for testing a press-to-actuate switch having a depressible element comprising the steps of:

lowering a plunger onto the depressible element;

applying a first force to the plunger while monitoring the switch for actuation;

applying a second force to the plunger less than said first force;

applying a third force to the plunger while monitoring the switch for actuation;

retracting the plunger from the depressible element.

3. A method for testing a press-to-actuate switch having a depressible element comprising the steps of:

lowering a plunger onto the depressible element;

applying a first force to the plunger while monitoring the switch for actuation;

applying a second force to the plunger less than said first force;

applying a third force to the plunger greater than said first force while monitoring the switch for actuation;

retracting the plunger from the depressible element.

4. A method as recited in claim 3 wherein the switch is monitored for actuation while the second force is applied to the plunger.

* * * * *